US008875928B1

(12) United States Patent
Bennett

(10) Patent No.: US 8,875,928 B1
(45) Date of Patent: Nov. 4, 2014

(54) SODA CARBONATION RETAINING APPARATUS

(71) Applicant: Paul T. Bennett, Highland, CA (US)

(72) Inventor: Paul T. Bennett, Highland, CA (US)

( * ) Notice: Subject to any disclaimer, the term of this patent is extended or adjusted under 35 U.S.C. 154(b) by 0 days.

(21) Appl. No.: 13/864,391

(22) Filed: Apr. 17, 2013

(51) Int. Cl.
*A61J 9/00* (2006.01)

(52) U.S. Cl.
USPC ..... 220/495.03; 220/625; 215/43; 215/11.3

(58) Field of Classification Search
CPC ..... A61J 9/00; A61J 9/001; A61J 9/085; A47G 19/22; A47G 19/2205
USPC ..... 220/495.03, 625, 626, 630; 215/11.3, 215/43, 40, 2
See application file for complete search history.

(56) References Cited

U.S. PATENT DOCUMENTS 3,955,698 A * 5/1976 Hammer ..... 215/11.3
4,033,091 A 7/1977 Saponara
4,139,127 A 2/1979 Gentile
4,524,877 A 6/1985 Saxby et al.
4,899,896 A 2/1990 Metzger
5,117,995 A 6/1992 Kau
5,356,016 A * 10/1994 Wiedemann ..... 215/11.3
D413,068 S 8/1999 Thouin et al.
6,230,931 B1 5/2001 Mandle et al.
2008/0041807 A1 * 2/2008 Tominaga ..... 215/11.3

* cited by examiner

*Primary Examiner* — Stephen Castellano

(57) ABSTRACT

A soda carbonation retaining apparatus includes a container has a bottom wall, a top wall and a perimeter wall. The bottom wall has an access aperture extending therethrough. The top wall has a nozzle fluidly coupled thereto. A plurality of tracks is mounted to an inner surface of the perimeter wall. A panel is mounted within the housing and is mounted on the tracks. A cover is positionable in a closed position closing the nozzle or in an open position exposing the nozzle. A flexible bag is mounted within the housing and has an upper edge attached to the perimeter wall adjacent to the top wall. The flexible bag is fillable with a carbonated fluid and a volume of the flexible bag is reduced as the panel is moved upwardly toward the nozzle to reduce an amount of free space in the flexible bag.

5 Claims, 7 Drawing Sheets

SODA CARBONATION RETAINING APPARATUS

BACKGROUND OF THE DISCLOSURE

Field of the Disclosure

The disclosure relates to carbonation retaining devices and more particularly pertains to a new carbonation retaining device for inhibiting the loss of carbonation from a fluid.

SUMMARY OF THE DISCLOSURE

An embodiment of the disclosure meets the needs presented above by generally comprising a container has a bottom wall, a top wall and a perimeter wall extending between each of the top and bottom walls. The bottom wall has an access aperture extending therethrough. The top wall has a nozzle fluidly coupled thereto to allow fluid within the container to pour outwardly through the nozzle. A plurality of tracks is mounted to an inner surface of the perimeter wall and each extends from the bottom wall and toward the top wall. A panel is mounted within the housing and is mounted on the tracks. A cover is positionable in a closed position closing the nozzle or in an open position exposing the nozzle. A flexible bag is mounted within the housing and has an upper edge attached to the perimeter wall adjacent to the top wall. The flexible bag is fillable with a carbonated fluid and a volume of the flexible bag is reduced as the panel is moved upwardly toward the nozzle to reduce an amount of free space in the flexible bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
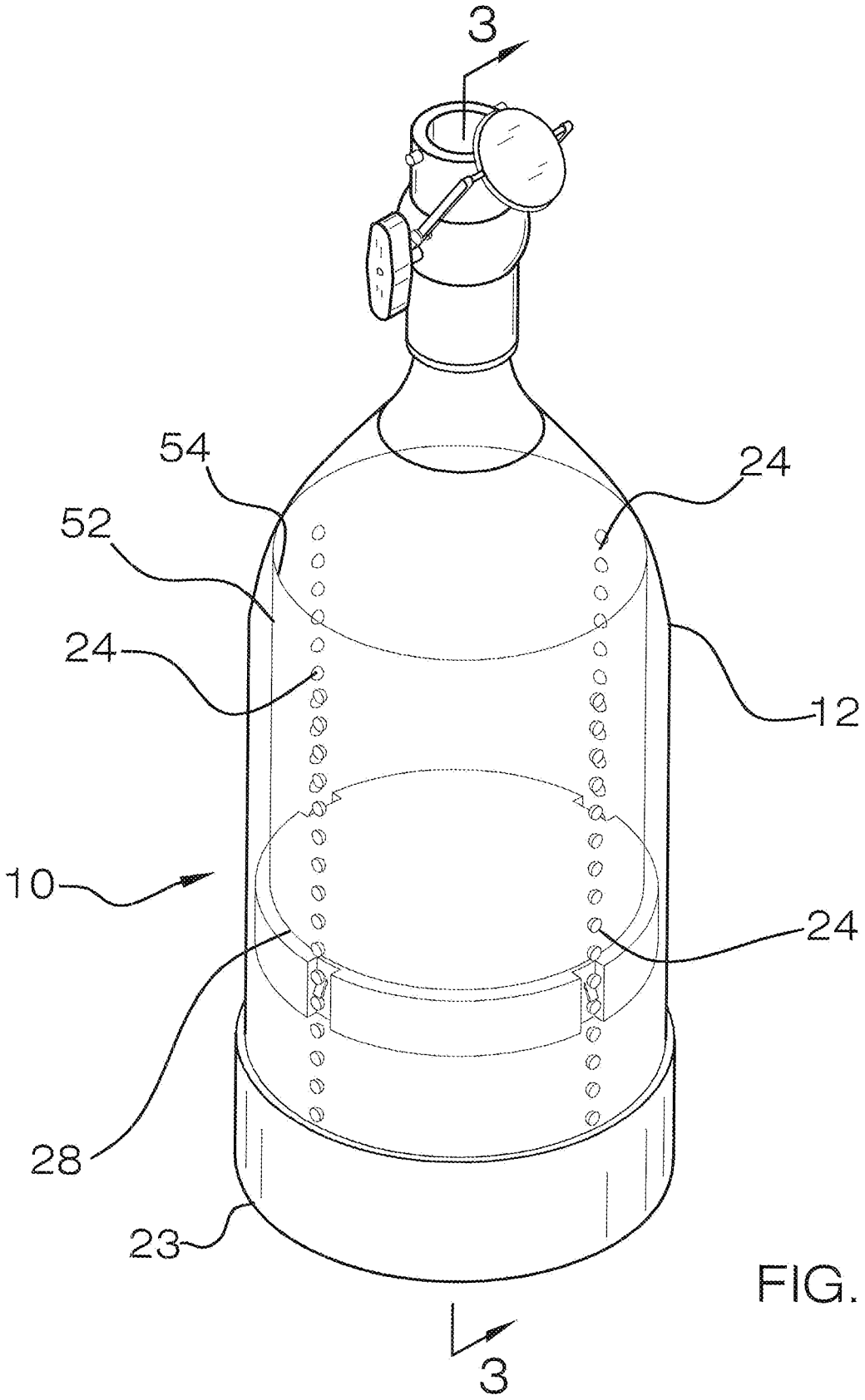
FIG. 1 is a front perspective view of a soda carbonation retaining apparatus according to an embodiment of the disclosure.

With reference now to the drawings, and in particular to FIGS. 1 through 7 thereof, a new carbonation retaining device embodying the principles and concepts of an embodiment of the disclosure and generally designated by the reference numeral 10 will be described.

Figure 2:
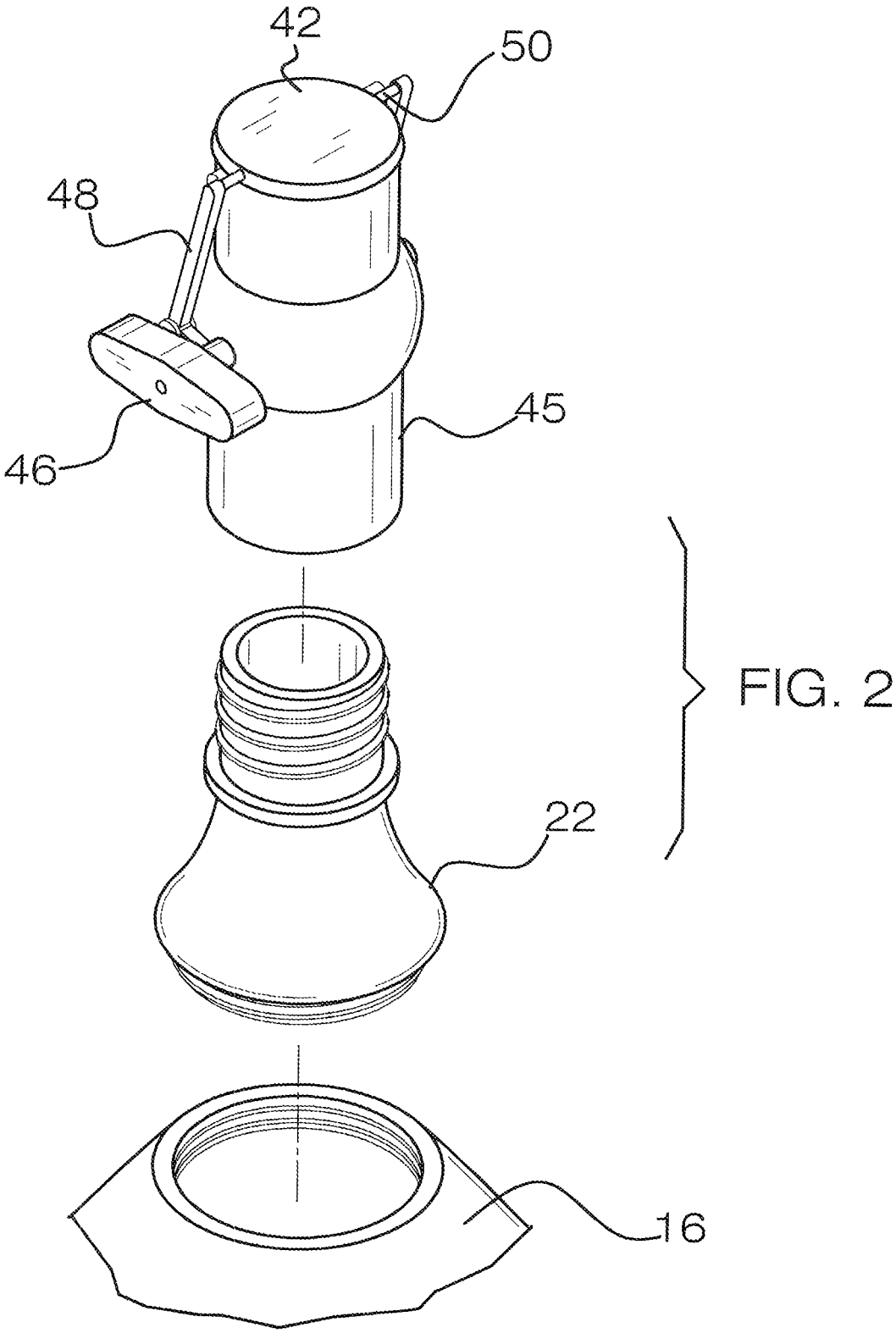
FIG. 2 is a front perspective exploded view of an embodiment of the disclosure.

As best illustrated in FIGS. 1 through 7, the soda carbonation retaining apparatus 10 generally comprises a container 12 that has a bottom wall 14, a top wall 16 and a perimeter wall 18 extending between each of the top 16 and bottom 14 walls. The bottom wall 14 has an access aperture 20 extending therethrough and the top wall 16 has a nozzle 22 fluidly coupled thereto to allow fluid within the container 12 to pour outwardly through the nozzle 22. The container 12 may resemble and utilize materials similar to conventional plastic beverage bottles. A base 23 may be attached to the bottom wall 14 which exposes the access aperture 20 but provides more rigidity to the container 12. As shown in FIG. 2, the nozzle 22 may be threadably coupled to the top wall 16.

Figure 3A:
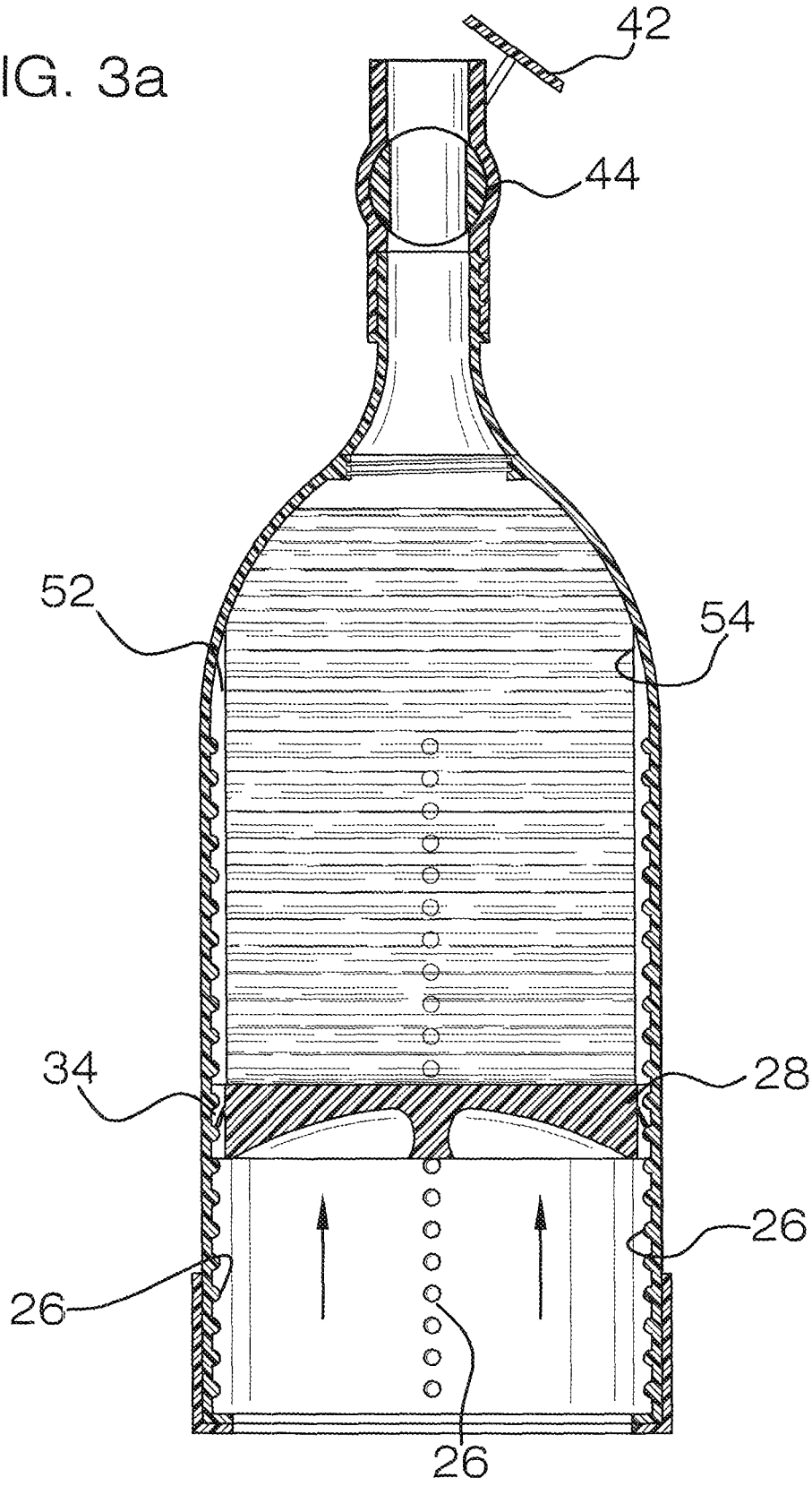
FIG. 3*a* is a cross-sectional view of an embodiment of the disclosure taken along line 3-3 of FIG. 1.
Figure 3B:
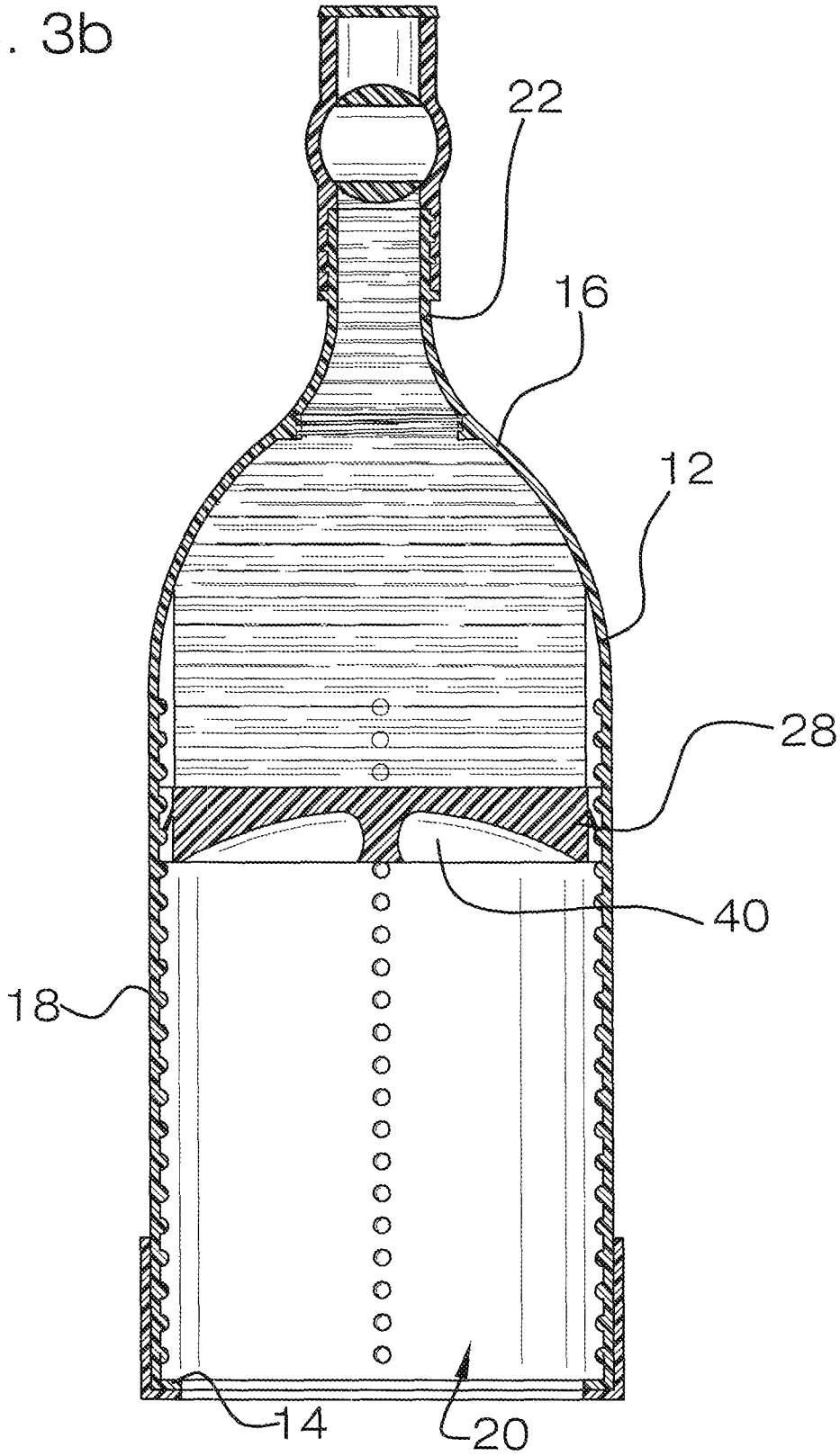
FIG. 3*b* is a cross-sectional view of an embodiment of the disclosure in a closed position.
Figure 5:
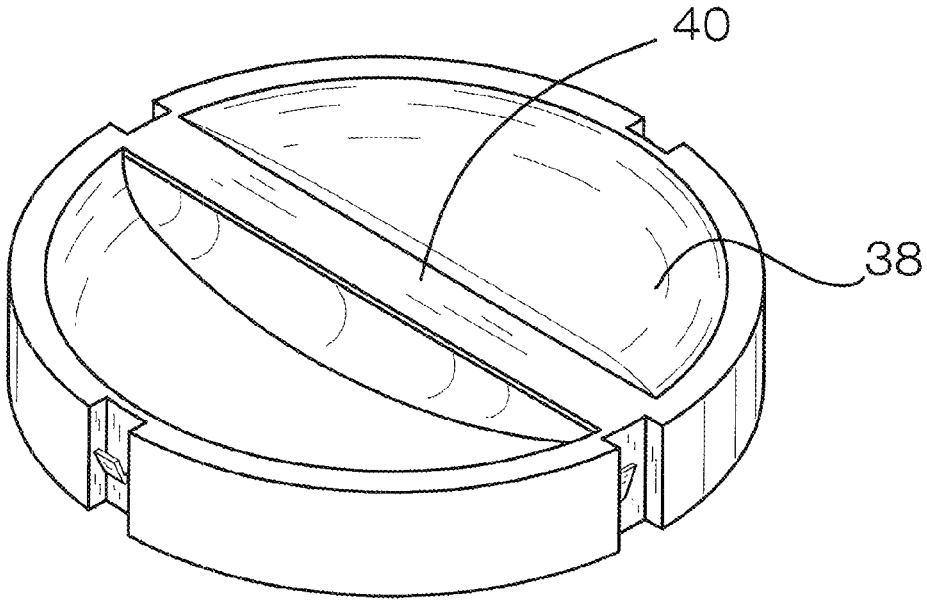
FIG. 5 is a bottom perspective view of a panel of an embodiment of the disclosure.
Figure 6:
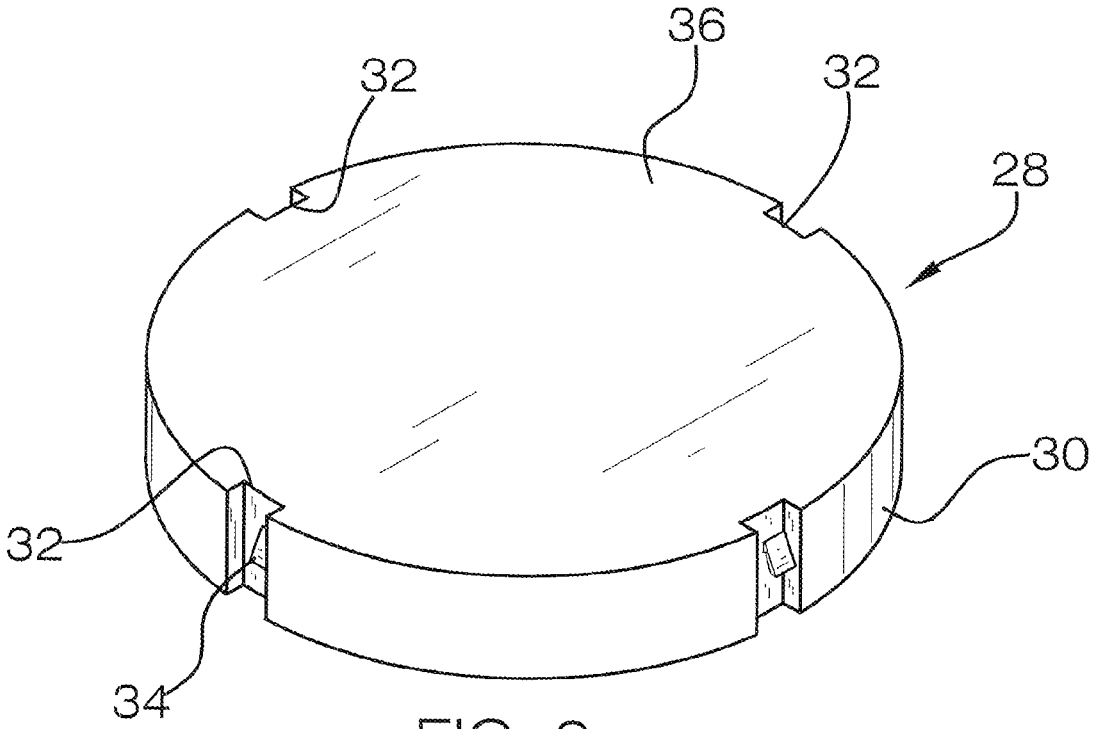
FIG. 6 is a top perspective view of the panel of an embodiment of the disclosure.
Figure 7:
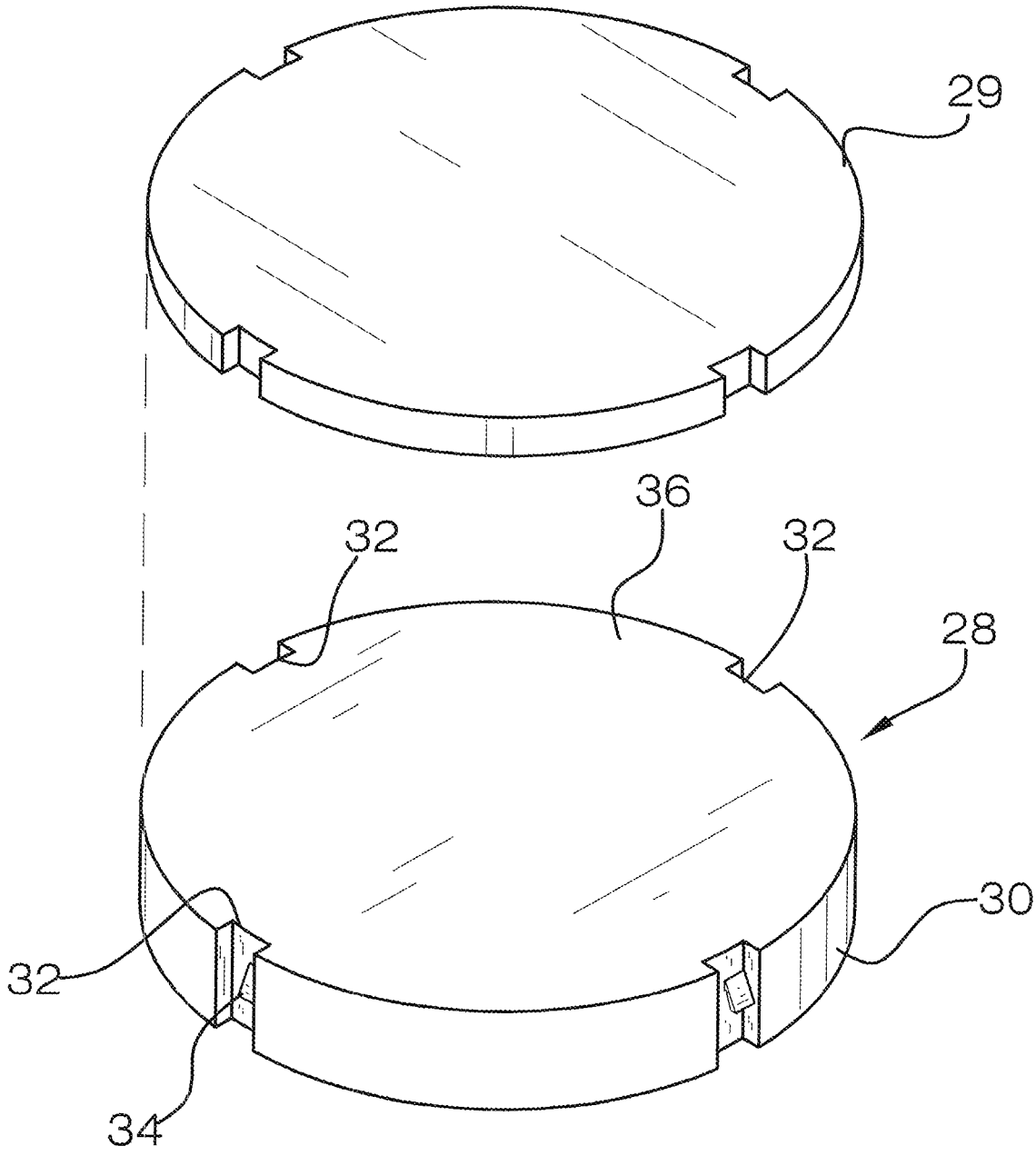
FIG. 7 is a top perspective view of the panel of an embodiment of the disclosure.

A plurality of tracks 24 is mounted to an inner surface of the perimeter wall 18. Each of the tracks 24 extends from the bottom wall 14 and toward the top wall 16. The tracks 24 include outwardly extending nubs 26 which may have a rounded outer edge or more particularly have a hemispherical shape. The nubs 26 may be vertically spaced from each other as shown in FIG. 3*a*. A panel 28 is mounted within the container 12 and is mounted on the tracks 24. The tracks 24 retain the panel 28 in a horizontal orientation. The panel 28 has a perimeter edge 30 having notches 32 therein. Each of the tracks 24 is positioned in one of the notches 32. A plurality of tabs 34 is attached to the panel 28 such that each of the notches 32 has one of the tabs 34 therein. The tabs 34 engage the nubs 26 to restrict downward movement of the panel 28 toward the bottom wall 14 and allow upward movement of the panel 28 toward the top wall 16. As shown in FIG. 6, the tabs 24 may have a width less than the width of the notches 32 to allow the nubs 26 to slide between an edge of the notches 32 and the tabs 34 to facilitate lowering of the panel 28 in the container 12. The panel 28 has an upper side 36 and lower side 38. The lower side 38 has a grip 40 formed therein as shown in FIG. 5. As shown in FIG. 7, a disk 29, may be positioned on top of the panel 28. The disk 29 is form fitted to the nubs 26 to prevent a pressurized bag from moving between the perimeter wall 18 and the notches where they may catch on the tabs 34.

Figure 4A:
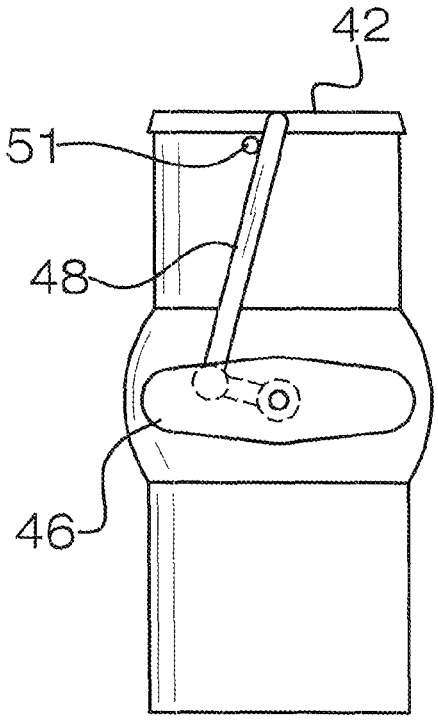
FIG. 4*a* is a side view of an embodiment of the disclosure in a closed position.
Figure 4B:
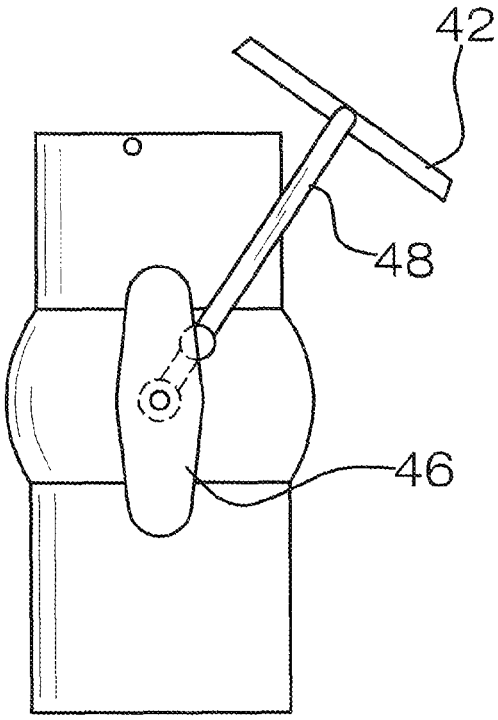
FIG. 4*b* is a side view of an embodiment of the disclosure in an open position.

A cover 42 is positionable in a closed position closing the nozzle 22 or in an open position exposing the nozzle 22. A valve 44 is in fluid communication with the nozzle 42. The valve 44 is actuatable between an open orientation and a closed orientation. The valve 44 and cover 42 may be part of a sleeve 45 threadably coupled to the nozzle 22. However, for purposes of the invention, the nozzle 22 shall be defined to include the valve 44 and cover 42. The valve 44 may comprise a conventional ball valve. The valve 44 includes a handle 46 attached to the cover 42. The cover 42 is pulled onto the nozzle 22 into the closed position when the handle 46 is rotated to move the valve 44 into the closed orientation. This may be accomplished with an arm 48 attached to and extending between the handle 46 and the cover 42 as shown in FIGS. 4*a* and 4*b*. A stabilizer 50 may be attached to the cover 42 and rotatably attached to the nozzle 22 opposite of the handle 46. The arm 48 and stabilizer 50 may be articulating and include spring mechanisms, not shown, to further pull the cover 42 onto the nozzle 22. A stop 51 attached to the nozzle 22 retains the arm 48 in place.

A flexible bag 52, or liner which may be comprised of a plastic material, is mounted within the container 12 and has an upper edge 54 attached to the perimeter wall 18 adjacent to the top wall 16, though it may also be attached to the top wall 16 itself. The flexible bag 52 is fillable with a carbonated fluid. The flexible bag 52 prevents the fluid from seeping between the tracks 24 and the notches 32. A volume of the flexible bag 52 is reduced as the panel 28 is moved upwardly toward the nozzle 22 to reduce an amount of free space in the flexible bag 52. The nubs 26 are rounded to prevent tears in the bag 52.

In use, the container 12 is used to hold fluids having carbonation such as soda and the like. When opened, fluid is poured out through the nozzle 22. When the user is finished, the panel 28 is moved upwardly to reduce the free area within the flexible bag 52. This will prevent carbonation in the fluid from escaping into the free area which will leave the fluid "flat" and having lower carbonation content.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A carbonation retaining apparatus for inhibiting the dispersal of carbonation from a carbonated liquid, said apparatus including:

a container having a bottom wall, a top wall and a perimeter wall extending between each of said top and bottom walls, said bottom wall having an access aperture extending therethrough, said top wall having a nozzle fluidly coupled thereto to allow fluid within said container to pour outwardly through said nozzle;

a plurality of tracks being mounted to an inner surface of said perimeter wall and positioned along a lines extending from an area adjacent to said bottom wall and toward said top wall;

a panel being mounted within said container and being mounted on said tracks;

a cover being positionable in a closed position closing said nozzle or in an open position exposing said nozzle;

a flexible bag being mounted within said container and having an upper edge attached to said perimeter wall adjacent to said top wall, said flexible bag being fillable with a carbonated fluid and a volume of said flexible bag being reduced as said panel is moved upwardly toward said nozzle to reduce an amount of free space in said flexible bag; and said tracks each include nubs extending away from said inner surface inwardly of said container, said panel having a perimeter edge having notches therein, each of said tracks being positioned in one of said notches, a plurality of tabs being attached to said panel such that each of said notches has one of said tabs therein, said tabs engaging said nubs to restrict downward movement of said panel toward said bottom wall and allow upward movement of said panel toward said top wall, said panel having an upper side and lower side, said lower side having a grip therein.

2. The apparatus according to claim 1, further including a valve being in fluid communication with said nozzle, said valve being actuatable between an open orientation and a closed orientation.

3. The apparatus according to claim 2, wherein said valve includes a handle attached to said cover, said cover being pulled onto said nozzle into said closed position when said handle is rotated to move said valve into said closed orientation.

4. A carbonation retaining apparatus for inhibiting the dispersal of carbonation from a carbonated liquid, said apparatus including:

a container having a bottom wall, a top wall and a perimeter wall extending between each of said top and bottom walls, said bottom wall having an access aperture extending therethrough, said top wall having a nozzle fluidly coupled thereto to allow fluid within said container to pour outwardly through said nozzle;

a plurality of tracks being mounted to an inner surface of said perimeter wall and positioned along a lines extending from an area adjacent to said bottom wall and toward said top wall, said tracks including nubs extending away from said inner surface towards an interior of said container;

a panel being mounted within said container and being mounted on said tracks, said panel having a perimeter edge having notches therein, each of said tracks being positioned in one of said notches, a plurality of tabs being attached to said panel such that each of said notches has one of said tabs therein, said tabs engaging said nubs to restrict downward movement of said panel toward said bottom wall and allow upward movement of said panel toward said top wall, said panel having an upper side and lower side, said lower side having a grip therein;

a cover being positionable in a closed position closing said nozzle or in an open position exposing said nozzle;

a valve being in fluid communication with said nozzle, said valve being actuatable between an open orientation and a closed orientation, said valve including a handle attached to said cover, said cover being pulled onto said nozzle into said closed position when said handle is rotated to move said valve into said closed orientation; and a flexible bag being mounted within said housing container and having an upper edge attached to said perimeter wall adjacent to said top wall, said flexible bag being fillable with a carbonated fluid and a volume of said flexible bag being reduced as said panel is moved upwardly toward said nozzle to reduce an amount of free space in said flexible bag.

5. A carbonation retaining apparatus for inhibiting the dispersal of carbonation from a carbonated liquid, said apparatus including:

a container having a bottom wall, a top wall and a perimeter wall extending between each of said top and bottom walls, said bottom wall having an access aperture extending therethrough, said top wall having a nozzle fluidly coupled thereto to allow fluid within said container to pour outwardly through said nozzle;

a plurality of tracks being mounted to an inner surface of said perimeter wall and positioned along a lines extending from an area adjacent to said bottom wall and toward said top wall;

a panel being mounted within said container and being mounted on said tracks;

a cover being positionable in a closed position closing said nozzle or in an open position exposing said nozzle; and a flexible bag being mounted within said container and having an upper edge attached to said perimeter wall adjacent to said top wall, said flexible bag being fillable with a carbonated fluid and a volume of said flexible bag being reduced as said panel is moved upwardly toward said nozzle to reduce an amount of free space in said flexible bag;

a valve being in fluid communication with said nozzle, said valve being actuatable between an open orientation and a closed orientation, said valve including a handle attached to said cover, said cover being pulled onto said nozzle into said closed position when said handle is rotated to move said valve into said closed orientation.

* * * * *